United States Patent [19]

Maringer

[11] Patent Number: 4,614,222

[45] Date of Patent: Sep. 30, 1986

[54] METHOD OF AND APPARATUS FOR CASTING METAL STRIP EMPLOYING FREE GAP MELT DRAG

[75] Inventor: Robert E. Maringer, Worthington, Ohio

[73] Assignee: Battelle Development Corporation, Columbus, Ohio

[21] Appl. No.: 610,721

[22] Filed: May 16, 1984

[51] Int. Cl.[4] ..... B22D 11/06; B22D 11/10; B22D 11/18

[52] U.S. Cl. ..... 164/463; 164/423; 164/429; 164/437; 164/438; 164/479; 164/488

[58] Field of Search ..... 164/463, 479, 488, 423, 164/429, 437, 438

[56] References Cited

U.S. PATENT DOCUMENTS

| | | | |
|---|---|---|---|
| 3,338,295 | 8/1967 | Scribner | 164/479 |
| 3,354,937 | 11/1967 | Jackson, Jr. | 164/479 |
| 3,587,717 | 6/1971 | Yamauchi et al. | 164/452 X |
| 3,908,745 | 9/1975 | Caldwell et al. | 164/479 X |
| 4,073,334 | 2/1978 | Gerding | 164/479 |
| 4,142,571 | 3/1979 | Narasimhan | 164/463 |

FOREIGN PATENT DOCUMENTS

| | | | |
|---|---|---|---|
| 2070479A | 9/1981 | United Kingdom | 164/429 |

*Primary Examiner*—Nicholas P. Godici
*Assistant Examiner*—J. Reed Batten, Jr.
*Attorney, Agent, or Firm*—Barry S. Bissell

[57] ABSTRACT

Apparatus and method for continuous casting of amorphous or polycrystalline metal strip from a melt. The molten metal is delivered from a reservoir (2) to a moving chill surface, preferably a cylindrical roll (1) through an orifice (3) in the reservoir (2). The gap between the reservoir (2) and the chill surface (1) is not fixed as in prior methods but is variable due to a resilient bias on the reservoir toward the chill surface. A pivot (10) and counterweight (11) are convenient apparatus for resiliently biasing the reservoir. The small portion of the reservoir (2) therefore rides lightly upon the molten metal film delivered to the chill surface or upon the solidified metal strip. The variable gap allows better control over the process and better quality surfaces on the metal strip.

20 Claims, 8 Drawing Figures

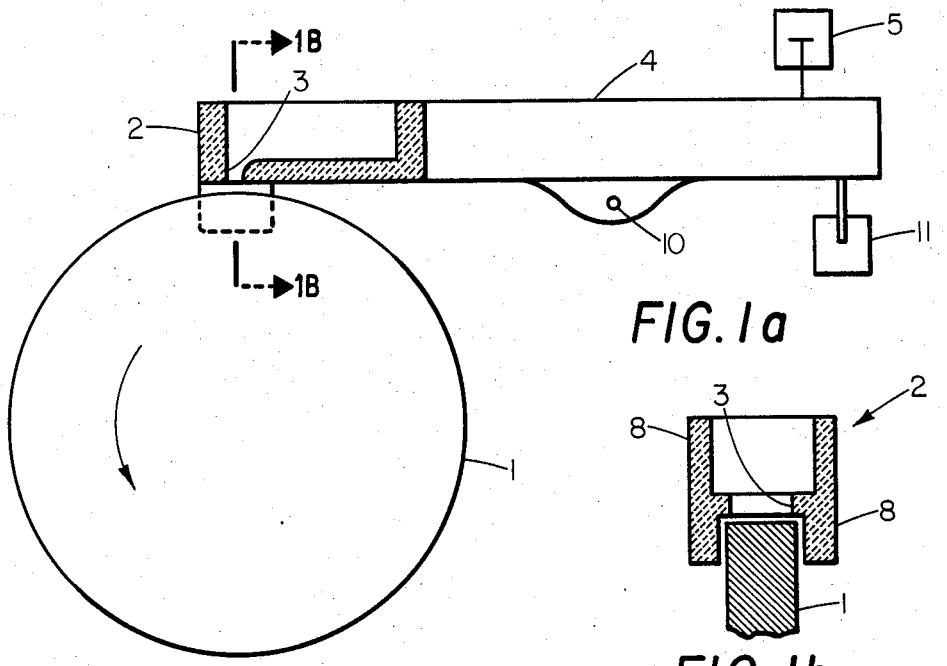
FIG. 1a
FIG. 1b
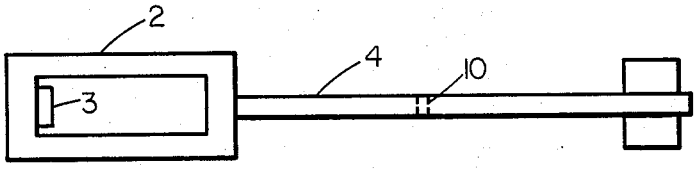
FIG. 2
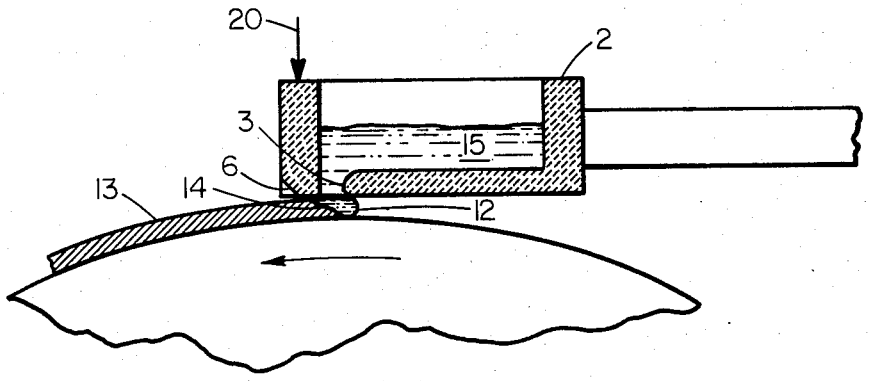
FIG. 3

METHOD OF AND APPARATUS FOR CASTING METAL STRIP EMPLOYING FREE GAP MELT DRAG

TECHNICAL FIELD AND BACKGROUND ART

The invention relates to rapid solidification of metals (RSM) to form amorphous or polycrystalline metal strip by the melt drag process. The melt drag process is disclosed in U.S. Pat. Nos. 3,522,836 and 3,605,863. It generally comprises forming a meniscus of molten metal at the outlet of a nozzle, and dragging a chill surface through the meniscus. Molten metal thereby contacts the chill surface and solidifies thereon to a solid metal strip. The gap thickness between the chill surface and the nozzle outlet is critical to obtaining a continuous, quality strip. In practice, the proper gap was found and then fixed by fixing the locations of the chill surface and the metal nozzle. The making of quality strip, particularly amorphous strip, therefore required accurate control over the gap, as well as the nozzle orifice size and the size of the nozzle walls (see U.S. Pat. No. 4,142,571, for example).

SUMMARY OF THE INVENTION

It is an object of the invention to define a process and apparatus for casting of amorphous or crystalline metal strip with less process control than is required with prior fixed gap apparatus.

The inventive method of casting metal strip comprises providing a chill surface in motion parallel to itself, providing a reservoir of molten metal having an orifice for delivering the metal to the chill surface, biasing the orifice and/or the chill surface toward one another such that the gap therebetween is variable, and delivering the metal to the chill surface to form a layer which solidifies to a strip and influences the gap between the orifice and the chill surface.

Metal is preferably delivered at only the metallostatic head pressure of the molten metal in the reservoir. This typically amounts to 0.5–2.0 psig. The peripheral surface of a chill wheel is the preferred casting surface. Side seals are preferably used on the reservoir to prevent leakage of molten metal from the casting surface.

The inventive apparatus comprises a moveable chill surface, a source of molten metal and metal delivery means including an orifice for delivering metal from the source to the chill surface, wherein the chill surface and delivery means are biased toward one another in close proximity and fixed for relative motion toward and away from each other such that the gap therebetween is changeable during use.

The preferred casting surface is the peripheral surface of a chill wheel and the preferred metal delivery means is a reservoir having side seals which overlap the periphery of the chill wheel to prevent spillage.

BRIEF DESCRIPTION OF THE DRAWINGS

FIG. 1(*a*) is a sectional elevation view of the apparatus according to the invention. FIG. 1(*b*) is a cross-sectional view of the reservoir taken along line 1B—1B of FIG. 1(*a*).

FIG. 2 is a plan view of the metal reservoir and counterbalance arm.

FIG. 3 is a close-up sectional view of the metal reservoir and a chill surface showing the formation of a metal strip.

DETAILED DESCRIPTION OF THE PREFERRED EMBODIMENTS

Figure 4B:
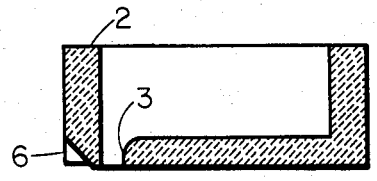
FIG. 4(*a*) is an end view of a modified metal reservoir and FIG. 4(*b*) is a sectional elevation view along line 4B—4B thereof.

The preferred apparatus of the invention is shown in FIGS. 1–4. In FIG. 1(*a*), a continuous chill surface is represented by a chill wheel 1 having a smooth, metal surface of, for example, copper. The wheel may be cooled with gaseous or liquid coolant, either internally or externally.

A reservoir 2 having an orifice 3 is positioned above the chill wheel at about the 12 o'clock position. The reservoir is supported by means of a lever arm 4 and pivot 10. Counterweight 11 is used to control the bias of the reservoir toward the chill surface of the wheel. Dashpot 5 may be used to smooth out vibration in the lever during operation. Stops (not shown) are used to allow the reservoir to rest just above the chill surface to avoid actual contact when not in use.

The cross-sectional end view in FIG. 1(*b*) shows the reservoir design using side seals which has proved useful with large orifice sizes. The reservoir 2 is made wider than the chill wheel 1 so that the vertical walls 8 of the reservoir may be extended downwardly along the sides of the chill wheel. This provides a loose "seal" so that liquid metal does not appreciably flow off the chill surface down the sides of the wheel.

FIG. 2 shows the plan view of a reservoir 2 and lever arm 4. The pivot point on the lever arm has an effect on the gap between the reservoir and the chill wheel. The closer the pivot is to the end of the reservoir, the smaller the change in the gap at that end for any given gap change at the far end. It is preferred to move the pivot closer to the reservoir when casting thick strip so that melt will be better contained.

FIG. 3 shows a more detailed view of a modified reservoir and the formation of a metal strip according to the invention. The reservoir is shown with a tapered surface 6 downstream of the orifice. As shown in FIG. 3, molten metal in reservoir 2 exits through the orifice 3 and forms a pool of metal 12 on the chill surface. The molten metal solidifies along a solidification front 14 making solid metal strip 13. A positive net force 20 is applied by means of the counterweight 11 and the weight of the apparatus and liquid metal to bias the reservoir toward the wheel and therefore to ride lightly on the liquid metal 12 and solid metal strip 13. This eliminates the need in the prior art to control the fixed gap between the orifice and the chill surface. The present free gap is controlled automatically and continuously by the dynamics of the process itself. The quality of both surfaces of the strip are also improved by this free gap process. By the word "bias", I intend to mean urging the apparatus in a particular direction by means of a steady force applied to the apparatus.

The chill surface may be any continuous substrate. For example, an endless belt or flat disk may be used, but a cylindrical wheel is preferred. The surface is preferably cooled by means of a circulating liquid coolant.

By the term "strip" I mean to include conventional flat strip as well as strip with corrugation, variable thickness, perforations, etc. Different cross-sections may be produced by the use of multiple orifices, changing gaps and/or embossed chill wheel casting surfaces.

Figure 4A:
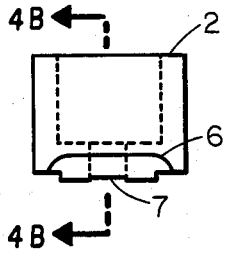

The reservoir may be made of any convenient material which will withstand the conditions. Both silicate bonded zircon and tabular alumina have been used, for example. A preferred reservoir shape is shown in FIGS. 4(*a*) and 4(*b*). A tapered surface 6 may be formed on the downstream end of the reservoir and a flat, recessed area 7 may be machined directly downstream of the orifice 3. The bottom surface of the reservoir, at least near the orifice, may also have an upwardly concave shape to more near match the arc of the chill wheel.

The orifice width is a factor in determining strip thickness (by width I mean the dimension in the direction of movement of the chill surface). In general, narrower orifices have been found useful when making thin, amorphous strip and wider orifices have been found useful for thicker polycrystalline strip. The wider orifices are generally preferred in that they can not only be used to make thin strip at high wheel speeds and thicker strip at low speeds, but they are also not as susceptible to clogging. Widths of 1–10 millimeters have been used successfully and somewhat wider or narrower orifices should also be useable.

The speed of the chill surface may be varied considerably and is usually coordinated with the orifice size to produce the desired strip thickness and chill rate. Of course, strip thickness generally decreases as speed increases. Speeds on the order of 100–5000 ft/min (30–1500 m/min) are typical. Useful strip can, however, be made outside of this range.

As shown in FIG. 1(*a*), a dashpot or damper 5 is preferably used on the lever arm to smooth out vibration and variation in the gap caused by oxide particles or other discontinuities on the strip surface which deflect the reservoir from a steady-state position.

FIGS. 4(*a*) and 4(*b*) show another modification to the reservoir 2. The leading surface of the reservoir downstream of the orifice 3 has a tapered section 6 and a recessed flat area 7 between the tapered section and the orifice. These modifications have appeared useful for getting a good flow of liquid metal from the reservoir as shown in FIG. 3 and for minimizing contact with the metal in the downstream location. This in turn appears to reduce splashing, increase strip thickness and reduce orifice erosion.

Figure 5:
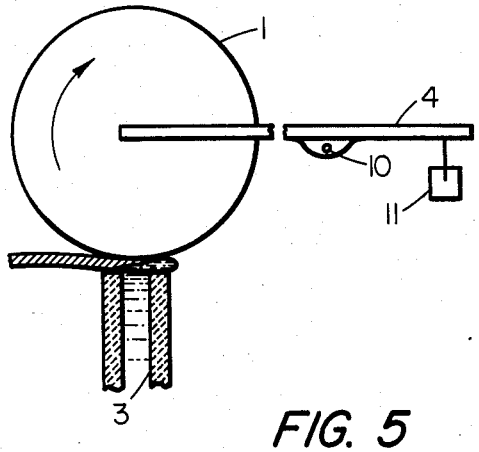
FIG. 5 shows an alternative embodiment wherein the chill wheel is free to move against a fixed nozzle.
Figure 6:
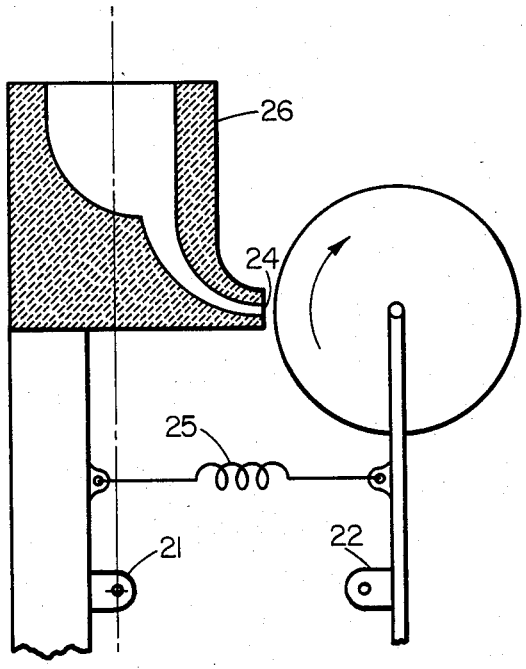
FIG. 6 shows another embodiment wherein a reservoir and the chill wheel are biased together with a spring and metal strip is formed from the 9 o'clock position on the chill wheel.

Proposed modifications of the apparatus are shown in FIGS. 5 and 6. In FIG. 5, the position of the nozzle is fixed and the chill wheel is levered so that it is free to move. This mode has not been used, but appears feasible for some applications. However, because the size and weight of the wheel for wider strip may become large, certain control problems may be experienced. Scaling up the process appears much easier using the apparatus of FIGS. 1(*a*) and 1(*b*).

FIG. 6 shows an alternative wherein the molten metal contacts the chill wheel on one side. Either or both of the wheel or reservoir could be moveable. In the Figure, both are exemplified as being moveable about pivots 21 and 22 and being biased toward each other by a spring 25. Routine experimentation will show the user what spring tension will produce adequate strip. In general, a small bias is sufficient. A reservoir 26 having a nozzle 24 supplies metal to the surface. It is preferred that the center of gravity of the reservoir be vertically above the pivot so that changes in the metal level in the reservoir will not alter the bias toward the chill wheel.

In utilizing the apparatus to form strip, any of the conventional metals and alloys can be used. Tin, iron, copper, aluminum, nickel and their alloys are typical examples. The method can be understood by referring to FIG. 3. The reservoir 2 is typically preheated to begin the process, after which the chill wheel 1 is rotated and molten metal 15 poured into the reservoir. As metal advances through the orifice 3 and begins to solidify on the chill surface, the reservoir is raised by the liquid and solidified metal from a position just above the chill surface to a higher, steady state position. The thickness of the strip and resulting gap between the reservoir and wheel appear largely to be a function of the molten metal flow rate to the chill wheel, the speed of the wheel and the net force 20.

To reduce clogging, it is desirable to use a large orifice and a high wheel speed to form the strip. Preferably, no external pressure is applied and the total pressure (metallostatic head plus external pressure) is limited to about 0.1–2 psig. Lower density metals may need either higher reservoirs to increase head height or overpressures to assure adequate flow rates to the chill surface. Higher chill surface speeds may also necessitate higher pressures to maintain adequate flow.

The pressure and the wheel speed should be coordinated such that a rounded surface of molten metal 12 is formed upstream of the orifice as shown in FIG. 3. If this rounded surface is not formed, but the liquid boundary merely trails off downstream to the chill surface, the strip surface against the chill roll has an undesirably rough surface. I believe this is related to inclusion of gas bubbles between the strip and chill surface. Gas may be more easily trapped with the latter mentioned trailing liquid boundary.

Moreover, because of the large differences in velocity of liquid metal in the reservoir and on the chill surface, there is a rapid increase in the formation of new metal surface (not previously exposed to the atmosphere) in the region therebetween. By keeping the exposed metal surface in this region as small as possible, it has less exposure time to the atmosphere and consequently is of better quality.

The pressure needed to force the molten metal at the desired rate may come from the metallostatic head in the reservoir or from an external source. Total pressures of about 0.1–2 psig appear adequate. As is well known, reactive or inert gases may be used depending upon the desired product.

The reservoir is typically preheated to near the melt temperature. Otherwise a thick deposit tends to solidify on the bottom of the reservoir downstream of the orifice. The tapered section downstream of the orifice was also devised to counter the tendency of the metal to solidify on the reservoir lower surface in that region.

EXAMPLE 1

Carbon Steel Strip

Five test runs (Nos. 24–28) were made using the apparatus shown in FIGS. 1(*a*) and 1(*b*) and aluminum-killed, low carbon steel with the following composition:

| | |
|---|---|
| Carbon | 0.025% |
| Manganese | 1.31% |

-continued

| | |
|---|---|
| Aluminum | .117% |
| Sulfur | .017% |
| Phosphorus | .008% |
| Silicon | .011% |
| Tin | .005% |
| Copper | .021% |
| Chromium | .022% |
| Nickel | .027% |
| Molybdenum | .008% |
| Iron | Balance |

A wheel 78 cm in diameter and having a 5 cm wide copper chill surface therearound was used to form the strip. The pivot arm was about 1 m in length with the pivot being 33 cm from the nearer lip of the orifice. Cooling was provided by water circulation through internal tubing. A reservoir of zircon sand, such as shown in FIG. 3, was used. The orifice was 6.35 mm wide and 25.4 mm long. Molten metal was maintained in the reservoir at a level of about 3–5 cm. No external pressure was used. An argon gas blanket was used around the orifice. The orifice was substantially centered over the point of contact of a horizontal tangent to the chill surface. Counterweight was used to bring the net weight on the reservoir to about 2000 g.

At chill surface speeds of 610 cm/sec and pouring temperatures of 1700° C., a strip was formed with thicknesses ranging from 0.125–0.38 mm. At 760 cm/sec the strip thickness ranged from 0.076–0.125 mm.

EXAMPLE 2

Stainless Steel Strip

The same apparatus as above was used to form strip from Type 304 Stainless steel. In four runs (Nos. 1–4) under argon atmosphere and wheel speeds of 610 cm/sec, the strip thickness was between about 0.102 and 0.508 mm. Pouring temperature was about 1530° C.

The quality and thickness were not easily predictable with steel in these examples. I believe this was due to my inability to preheat the reservoir to a temperature near the melt temperature. The preheat was limited to about 1310° F. This caused some deposit of metal on the underside of the reservoir downstream of the nozzle which affected both quality and thickness of the strip. This problem did not arise with other lower melting metals since the preheat temperature was substantially equal to the melt temperature.

EXAMPLE 3

Wheel Speed Influence

The effect of wheel speed was investigated in a preliminary way using the low carbon steel and chill wheel of Example 1. A tundish similar to that shown in FIGS. 4(*a*) and 4(*b*) was used except that the corner between the orifice 3 and the recessed flat surface 7 was rounded. The position of the tundish was also varied relative to a perpendicular line drawn from the point of tangency of a horizontal line to the wheel. Typically, the front or downstream wall of the orifice was even with the perpendicular line (position=0), but the back or upstream wall was occasionally even (position=−2) or the point of intersection of the tapered surface 6 with the bottom of the reservoir was in line (position=+2).

TABLE 1

| Run No. | Tundish Position | Orifice Width (mm) | Length of Recessed Flat | Wheel Speed (cm/sec) | Strip Thickness (microns) |
|---|---|---|---|---|---|
| 39 | −2 | 12.7 | 4.8 | 406 | 381–634 |
| 40 | 0 | 12.7 | 4.8 | 610 | 280–508 |
| 43 | +2 | 6.35 | 7.95 | 610 | 280–406 |
| 44 | +2 | 6.35 | 7.95 | 610 | 508 |
| 45 | +2 | 6.35 | 7.95 | 305 | 381 |
| 46 | +2 | 6.35 | 7.95 | 610 | 254 |

The limited data above appears inconclusive, but it has been generally observed that the slower wheel speeds and larger orifices produce thicker strip on the average.

EXAMPLE 4

Strip Quality

A rough measure of the strip quality was defined as the ratio of the effective strip thickness to the measured thickness. The effective strip thickness was defined as:

$$\frac{\text{Mass}}{\text{Density} \times \text{Length} \times \text{Width}}$$

and represents the thickness of a flat strip having uniformly parallel top and bottom surfaces, uniform width and full density. A ratio near unity evidences a high quality strip.

The same chill wheel and low carbon steel of Example 1 were again used. The reservoir had either recessed or non-recessed flat surface 7 (shown recessed in FIG. 3) between the orifice and tapered surface 6. The length of this flat surface was measured and is reported below. The hardness of the metal strip was measured using a 100 g load.

TABLE 2

| Run No. | Tundish Position | Orifice Width (mm) | Length of Flat Surface (mm) | Flat Surface Position Recessed (R) Non-recessed (NR) | Strip Thickness (micrometers) | Ratio of Eff./meas. Thickness | Microhardness (KHN) |
|---|---|---|---|---|---|---|---|
| 29 | +2 | 12.7 | 7.95 | NR | 76 ± 20 | 0.605 | 150 ± 8 |
| 30 | −2 | 12.7 | 4.8 | NR | 76 ± 10 | 0.642 | 160 ± 8 |
| 31 | +2 | 12.7 | 4.8 | NR | 76 ± 15 | 0.595 | 150 ± 10 |
| 32 | 0 | 12.7 | 4.8 | R | 254 ± 8 | 0.533 | 198 ± 5 |
| 33 | +2 | 6.35 | 4.8 | R | 152 ± 25 | 0.596 | 191 ± 9 |
| 34 | 0 | 6.35 | 4.8 | NR | 127 ± 18 | 0.538 | 183 ± 12 |
| 35 | −2 | 6.35 | 4.8 | R | 216 ± 18 | 0.526 | 185 ± 7 |
| 36 | −2 | 6.35 | 7.95 | R | 203 ± 18 | 0.586 | 204 ± 11 |
| 37 | −2 | 12.7 | 7.95 | NR | 191 ± 13 | 0.614 | 201 ± 9 |
| 38 | +2 | 6.35 | 7.95 | R | 280 ± 8 | 0.597 | 218 ± 18 |
| 41 | 0 | 12.7 | 7.95 | R | 229 ± 18 | 0.516 | 214 ± 9 |

TABLE 2-continued

| Run No. | Tundish Position | Orifice Width (mm) | Length of Flat Surface (mm) | Flat Surface Position Recessed (R) Non-recessed (NR) | Strip Thickness (micrometers) | Ratio of Eff./meas. Thickness | Microhardness (KHN) |
|---|---|---|---|---|---|---|---|
| 42 | 0 | 6.35 | 7.95 | NR | 89 ± 18 | 0.533 | 181 ± 8 |

I claim:

1. A method for casting of metal strip from a melt comprising:

(A) providing a moving chill surface, (B) providing a reservoir of molten metal having an orifice for delivering the metal to the chill surface with a positive pressure at the first point of contact of the molten metal with the chill surface, (C) biasing the orifice and/or the chill surface toward one another such that the gap therebetween is variable, and (D) delivering molten metal from the orifice to the chill surface so as to form a layer of molten metal on the chill surface which solidifies to a metal strip and which influences the gap between the orifice and the chill surface and which issues at a linear speed substantially equal to the speed of the chill surface.

2. The method of claim 1 wherein the molten metal is delivered at a total pressure of about 0.5–2.0 psig.

3. The method of claim 2 wherein the molten metal is delivered substantially only under the metallostatic head pressure.

4. The method of claim 1 for continuous casting of metal strip wherein molten metal is delivered to a peripheral surface of a chill wheel.

5. The method of claim 4 which further comprising damping any movement of the reservoir toward the chill wheel.

6. The method of claim 4 wherein the reservoir is preheated prior to delivering metal to the chill surface.

7. The method of claim 4 for forming amorphous metal strip which further comprises controlling the orifice size, melt flow through the orifice and chill surface velocity and temperature to cast a thin layer of molten metal on the chill surface which cools at a rate sufficient to form an amorphous structure.

8. The method of claim 4 wherein the chill wheel axis of rotation is substantially horizontal and the molten metal is deposited on the upper one-half of the chill wheel surface.

9. The method of claim 8 wherein the chill wheel position is fixed and the reservoir is biased toward the chill wheel.

10. The method of claim 9 wherein the bias is provided solely from the weight of the reservoir, the melt therein and the structural components of the reservoir.

11. The method of claim 9 which further comprises providing a side seal from the reservoir to the chill wheel for reducing the loss of melt from the chill surface prior to solidification.

12. The method of claim 9 for casting metal strip which further comprises levering the reservoir such that the fulcrum is substantially below the center of gravity of the filled reservoir such that the bias effect of changes in the quantity of melt in the reservoir is minimized.

13. Apparatus for casting of metal strip from a melt comprising:

(A) a moveable chill surface for casting molten metal thereon and for solidification of the molten metal to a solid strip issuing at substantially the same linear speed as the speed of the chill surface, (B) a source of molten metal, and (C) metal delivery means including an orifice for delivering molten metal from the source to the chill surface at positive pressure at first contact wherein said chill surface and metal delivery means are biased toward one another in close proximity and fixed for relative movement toward and away from each other such that the gap therebetween may change during use.

14. The apparatus of claim 13 wherein the chill surface comprises the periphery of a wheel.

15. The apparatus of claim 14 wherein the metal delivery means is fixed and the chill wheel is moveably biased toward the metal delivery means.

16. The apparatus of claim 14 wherein both the metal delivery means and the chill wheel are fixed for movement toward and away from the other.

17. The apparatus of claim 14 wherein the metal delivery means comprises a reservoir having a lower surface and side walls and wherein the orifice is a slot in the lower surface.

18. The apparatus of claim 17 wherein the reservoir further comprises side seals which overlap the sides of the chill wheel to reduce spillage of melt from the chill surface.

19. The apparatus of claim 17 wherein the reservoir is positioned by means of a cantilever arm.

20. The apparatus of claim 19 wherein the lever arm is connected to a damper.

* * * * *